United States Patent [19]

Nielsen

[11] 4,154,291

[45] May 15, 1979

[54] MANDREL FOR CONTINUOUS CASTING OF TUBULAR METALLIC MEMBERS

[75] Inventor: Thomas D. Nielsen, Elyria, Ohio

[73] Assignee: Western Reserve Manufacturing Co., Inc., Lorain, Ohio

[21] Appl. No.: 842,457

[22] Filed: Oct. 17, 1977

[51] Int. Cl.[2] ..... B22D 11/10

[52] U.S. Cl. ..... 164/421; 164/85

[58] Field of Search ..... 164/85, 421

[56] References Cited

U.S. PATENT DOCUMENTS

| | | | |
|---|---|---|---|
| 2,466,612 | 4/1949 | Phillips et al. | 164/85 |
| 3,342,252 | 9/1967 | Wood et al. | 164/421 |
| 3,578,065 | 5/1971 | Langer | 164/85 |
| 3,707,439 | 12/1972 | Poeste et al. | 164/85 X |
| 3,710,840 | 1/1973 | Fabens, Jr. | 164/85 |
| 4,000,773 | 1/1977 | Sevastakis | 164/421 |

*Primary Examiner*—Othell M. Simpson
*Assistant Examiner*—K. Y. Lin
*Attorney, Agent, or Firm*—Fay & Sharpe

[57] ABSTRACT

A mandrel for use in the continuous casting of tubular metallic members and receivable in a continuous casting die in a spaced relationship relative to the die side walls. The mandrel is preferably constructed from graphite to include a distinct freeze area or zone intermediate the mandrel ends. This freeze area has a constant cross-sectional dimension over the length thereof to substantially accommodate freezing of metal from a liquid to a solid state in a desired configuration during a casting operation. An elongated bore extends longitudinally inward into the mandrel from the outermost end, through the freeze area and at least partially through the area of the mandrel between the freeze area and the innermost end. This bore advantageously facilitates a reduction in the amount of heat conducted through the mandrel from the innermost end toward the outermost end during a continuous casting operation to thereby aid in insuring transition of the metal from a liquid to a solid state substantially along the freeze area.

14 Claims, 3 Drawing Figures

MANDREL FOR CONTINUOUS CASTING OF TUBULAR METALLIC MEMBERS

BACKGROUND OF THE INVENTION

This invention pertains to the art of continuous casting and more particularly to continuous casting die apparatus.

The invention is particularly applicable to a mandrel employed for continuous casting of generally tubular metallic members and will be described with particular reference thereto. However, it will be appreciated that the invention has broader applications and could be adapted for use in other environments by those skilled in the art. Typical of the metals continuously cast and to which the subject invention is particularly applicable are brass, aluminum, bronze and the like, although many other metals and alloys can also be advantageously continuous cast using the subject inventive concepts.

In continuous casting tubular members, two general types of casting systems are employed. The first requires the casting to move at a constant speed while the die reciprocates along the casting longitudinal axis. The die moves downward at the same or a greater speed than the casting and moves upwardly at approximately 3 times the descent velocity with the amplitude of reciprocation typically being $\frac{1}{8}$" or less. The second method is one in which the die is stationary and the casting moves intermittently to effect the required casting conditions. During a withdrawal stroke, the casting moves fast enough so that only liquid metal enters the cooled length of the die, causing intimate die-metal contact. The stroke is followed by a dwell period during which the casting stops or slows down so that it will exit from the solidification zone at the proper temperature. The concepts of the subject invention are particularly directed and applicable to this latter system.

In such systems, it has been found particularly desirable to be able to provide a fairly compact die and mandrel arrangement which would also facilitate obtaining generally smooth inside and outside surface finishes on the continuous cast member and which would further facilitate the production of a member falling within acceptable tolerance ranges. To accomplish these ends, it has been found desirable to have the molten metal pass from a liquid to a solid state at a fairly precise area along the mandrel over a limited length thereof and to prevent the conduction of substantial heat flow from the uppermost area of the mandrel to the freeze or solidification area.

Prior attempts at obtaining such results have not proved entirely satisfactory. The subject invention, however, is deemed to fully meet these desires and provide a substantial improvement for mandrels employed in continuous casting of tubular metallic members.

BRIEF DESCRIPTION OF THE INVENTION

In accordance with the concepts of the subject invention, there is provided an improved mandrel configuration for use in the continuous casting of a generally tubular metallic member wherein the mandrel itself is operably received in and disposed to extend axially through at least a portion of a die from the die entrance end or area toward the die exit end or area. The outer surface of the mandrel and inner surface of the die thus act to define a chamber wherein the tubular member is cast. The mandrel is comprised of an elongated graphite body having a longitudinal axis. A first mandrel end includes means adjacent thereto adapted to fixedly position the mandrel relative to the die adjacent the die entrance end with a second mandrel end spaced toward the die exit end. The mandrel body includes a distinct longitudinally extending freeze area spaced intermediate the first and second ends having a constant cross-sectional dimension longitudinally therealong to substantially accommodate the transition of cast metal from a molten liquid to a solid state in a desired configuration. The mandrel body further includes an end area tapering inwardly from the freeze area toward the second end to accommodate free passage of the tubular member thereover and outwardly from the die exit end.

In accordance with another aspect of the present invention, the mandrel body includes an elongated bore at the second end extending longitudinally inward into the body through the tapered end area, the freeze area and into at least a portion of the body between the freeze area and the first end. This arrangement advantageously reduces the amount of heat conducted through the mandrel body from the first to the second end during a continuous casting operation for allowing greater control of metal freezing at the freeze area.

In accordance with another aspect of the invention, the freeze area has a length of approximately 1".

In accordance with still another aspect of the present invention, the bore extends into that portion of the mandrel body from the freeze area toward the first end a distance approximately equal to 1".

In accordance with still another aspect of the present invention, the bore has a cross-sectional dimension of approximately 1" less than the cross-sectional dimension of the freeze area when the freeze area cross-sectional dimension is greater than approximately 2".

The principal object of the present invention is the provision of a new and improved mandrel adapted for use in the continuous casting of metallic tubular members.

Another object of the present invention is the provision of a mandrel of this type which includes a distinctly defined freeze area or zone therealong.

Still another object of the present invention is the provision of a mandrel of this type which reduces heat conducted through the mandrel into the freeze area.

A still further object of the present invention is the provision of a mandrel of this type which is compact in length.

Additional objects and advantages of the present invention will become apparent to those skilled in the art upon a reading and understanding of the following specification.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein.

DESCRIPTION OF THE PREFERRED EMBODIMENT

Figure 1:
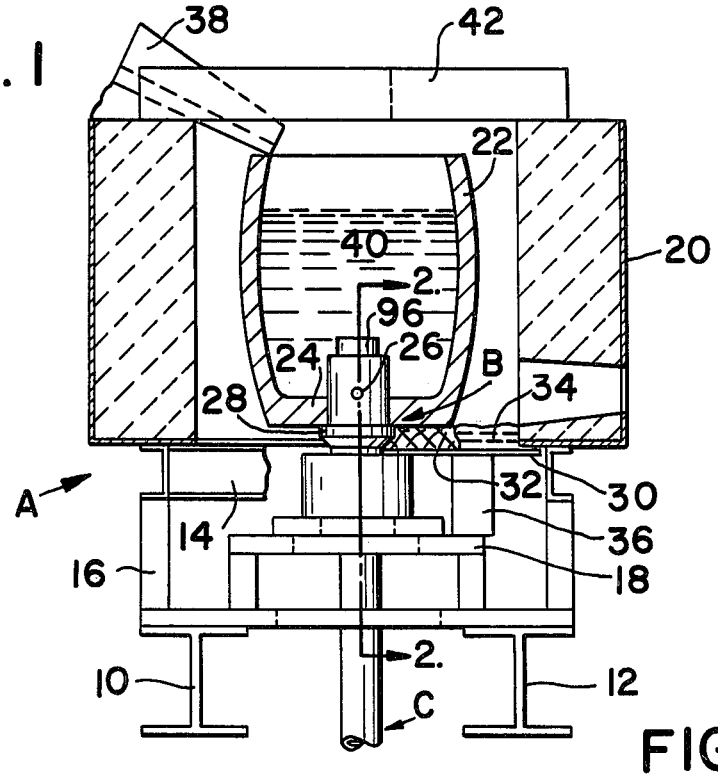
FIG. 1 is a view of a typical continuous casting facility for metallic tubular members in partial cross-section and schematic for ease of understanding the environment to which the invention is particularly directed.

Referring now to the drawings wherein the showings are for purposes of illustrating the preferred embodiment of the invention only and not for purposes of limiting same, FIG. 1 shows a continuous vertical casting facility A including a die and cooler assembly B for the continuous casting of a tubular member or strand C. A mandrel D (FIG. 2) is received within die and cooler assembly B to generate the hollow characteristic of strand C. Many different metals are cast using such apparatus and include brass, aluminum, bronze and the like. However, other metals and alloys can also be similarly cast. The type of material cast plays no substantial part with regard to practicing the concepts of the subject invention.

More particularly, continuous casting facility A may comprise any number of types or styles of such facilities which could advantageously incorporate the concepts of the subject invention thereinto. One such facility is generally schematically shown in FIG. 1 and includes a pair of spaced apart beam-like bases 10,12 supporting upper frame members generally designated 14,16. A platform type arrangement generally designated 18 is supported by members 10,12 which, itself, supports a portion of die and cooler assembly B. Platform type arrangement 18 includes suitable openings therethrough in line with the die and cooler assembly to permit passage of strand C therethrough. An open ended cylindrical holding furnace sleeve 20 is supported by frame members 14,16 and receives a generally cup-shaped crucible 22 therein. Crucible 22 includes a bottom wall 24 having a portion of die and cooler assembly B extending therethrough in a manner so that a plurality of peripherally spaced apart metal intake openings 26 thereof are placed in fluid communication with the inside of the crucible. A radially outward extending flange 28 on the die and cooler assembly engages the underside of bottom wall 24 to provide a convenient locating relationship between these components.

A bottom plate generally designated 30 is supported by a portion of the die and cooler assembly closely adjacent the bottom of holding furnace sleeve 20. This bottom plate in turn, provides a base for a cementous material generally designated 32 disposed about the lowermost end of the crucible and around a portion of the die and cooler assembly. This plate further provides a base for fire clay material 34 disposed between cementous material 32 and the inner wall of sleeve 20. Fire clay brick generally designated 36 is conveniently disposed between platform 18 and bottom plate 30. A pouring spout generally designated 38 facilitates the pouring of molten metal 40 from outside the holding furnace to crucible 22 and a holding furnace lid 42 is conveniently provided to cover the top of sleeve 20 to thereby substantially enclose the crucible.

During a continuous casting operation, tubular strand C emerges in a generally vertical disposition from the lower end of die and cooler assembly B. In the type of casting process to which the subject invention is particularly directed, appropriate pinch rolls (not shown) are disposed beneath the die and cooler assembly for withdrawing the strand from the die as it is being cast. These pinch rolls are conventional and include means for coordinating the operation with the remainder of the facility components in order to achieve the desired characteristics in strand C.

Casting facility A as shown in FIG. 1 merely comprises a general or schematic showing of the various components and their relative relationships in order to permit appreciation of the particular environment involved. The specific construction, components and so on may vary between individual continuous casting facilities, however, such variances do not in any way affect the overall scope or intent of the present invention. Moreover, in view of the fact that the facility itself does not form a part of the present invention and that the operation thereof is known in the art, a further detailed description is deemed unnecessary to a full and complete understanding of the invention.

Figure 2:
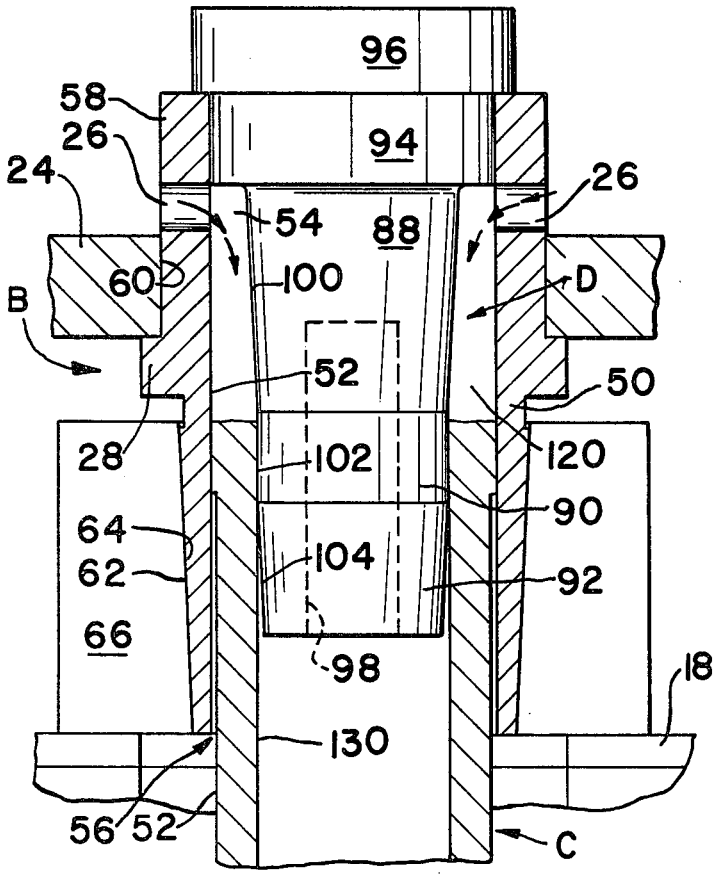
FIG. 2 is a partial cross-sectional view taken along lines 2—2 in FIG. 1 and showing the die and cooler assembly; and, FIG. 3 is an elevational view of a mandrel formed in accordance with the concepts of the subject invention.

FIG. 2 shows a partial cross-sectional view of die and cooler assembly B, mandrel D and a portion of a continuous tubular strand C during casting thereof. The casting die is comprised of a somewhat tubular shell-like arrangement generally designated 50. Typically, this shell-like arrangement is constructed from graphite such as that designated ATJ marketed by Union Carbide Corporation. In the preferred arrangement here under discussion, the internal surface 52 of the die is substantially cylindrical between the die entrance end or area generally designated 54 and the opposite exit end or area generally designated 56. It will be appreciated that the internal surface could take other cross-sectional configurations and is dependent upon the outer wall configuration desired in the tubular member to be cast. Outer wall 58 of member 50 has a generally cylindrical configuration over the upper end thereof which includes metal intake openings 26 and radially outward extending flange 28. As will be seen, this upper end of the die is closely received through opening 60 in bottom wall 24 of the crucible with intake openings 26 disposed above the inside of the crucible bottom wall and the flange 28 closely engaging the outside of the crucible bottom wall. Outer wall portion 62 has a tapered configuration tapering inwardly from adjacent flange 28 toward exit end 56 and is adapted to be closely received against tapered inner wall 64 of a cooler 66.

Cooler 66 may comprise any type of conventional cooling manifold for purposes of cooling the die and strand during a casting operation and does not, in and of itself, form any part of the present invention. Accordingly, further description thereof is deemed unnecessary except to the extent these manifolds are typically such that coolant is continuously circulated therethrough with the coolant inlet being spaced toward die exit end 56 and the coolant outlet being spaced adjacent the upper end.

Figure 3:
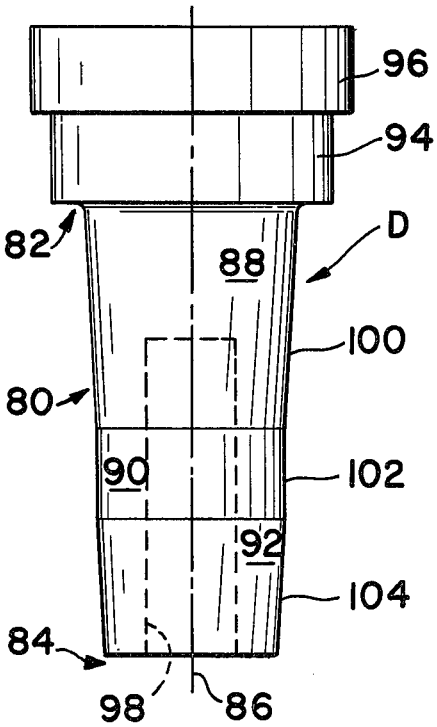

Referring now to FIG. 3, mandrel D is comprised of an elongated mandrel body 80 typically constructed from graphite such as that manufactured and marketed by Union Carbide Corporation under the designation ATJ. The mandrel portion of the body has a first end 82, a second end 84 and a longitudinal axis 86. This mandrel portion also includes a tapered metal entry area 88, a distinct freeze area 90 and a tapered end area 92. A first radially outward flanged area 94 is provided adjacent first end 82 and dimensioned to be closely received in shell 50 in the manner shown in FIG. 2. A second radially outward flanged area 96 is slightly larger than flange 94 and adapted to rest against the uppermost end face of shell 50 as also shown in FIG. 2. Convenient means such as retaining pins or the like (not shown) may be provided for passing transversely through shell 50 and into flange 94 to retain mandrel D in a positive position within the die itself. As will also be noted in FIG. 2, flange 94 is longitudinally dimensioned so that it does not extend past or interfere with intake openings 26 when the mandrel is positioned in the die.

Axially extending bore or opening 98 extends inwardly into mandrel body 80 from second end 84. As shown in FIG. 3, this bore extends through end area 92, freeze area 90 and into metal entry area 88. The length of this bore or opening and the fact that it extends into metal entry area 88 is particularly important to successful use of the mandrel for reasons which will become more readily apparent hereinafter. In the preferred arrangement here under discussion, bore or opening 98 has a cylindrical cross-section and is coaxially disposed with longitudinal axis 86. Other cross-sectional shapes and locations could however, also be advantageously employed to accommodate specific casting requirements without in any way departing from the overall intent or scope of the present invention. In the preferred arrangement here under discussion, areas 88,90 and 92 all have circular cross-sections to facilitate continuous casting of a hollow cylindrical tube. However, these areas, particularly freeze area 90, could have other cross-sectional configurations to provide a different internal configuration for the tube member without in any way departing from the overall intent of the present invention.

Side wall 100 of the metal entry area tapers inwardly from adjacent first end 82 to freeze area 90. The diameter of area 88 at first end 82 is greter than the final internal diameter or the strand and the diameter at the interface with freeze area 90 is equal to the diameter of the freeze area. Freeze area 90 comprises a distinct freeze or solidification zone wherein the cast metal is substantially transformed from a liquid to a solid state. Because of the overall operating parameters and adjustments typically included in a continuous casting facility, freeze area 90 may be of a fairly short length. The precise control of metal freezing also allows the overall length of both the die and mandrel to be shortened. Freeze area outer wall 102 has a constant cross-sectional configuration over the entire length thereof and, again, is circular in the preferred arrangement here under discussion. This distinct freeze area is one important aspect of the present invention in that it facilitates positive control of strand formation, i.e., transition of the metal from a liquid to a solid state, so that tolerance requirements may be more closely maintained. Further, this constant cross-sectional area provides for an important surface finish in the strand. Side wall 104 of end area 92 tapers inwardly from its interface with freeze area 90 to second end 84.

By way of specific example, it has been found that for the continuous casting of many tubular members having a wide range of internal and external diameters, freeze area 90 may have an axial length along longitudinal axis 86 of approximately 1" with the distance between mandrel portion first and second ends 82,84 being approximately 5". Moreover, it has also been found somewhat desirable to have axial bore or opening 98 extend axially into metal entry area 88 approximately 1" and to have the axial length of end area 92 along axis 86 be approximately 1½".

With regard to the cross-sectional dimension of bore 98, it is preferred that this dimension be equal to 1" less than the cross-sectional dimension of freeze area 90 when that dimension is greater than 2". In other words, and wih the preferred arrangement here under discussion where bore 98 and freeze area 90 are generally cylindrical, the diameter of bore 98 will be equal to 1" less than the diameter of the freeze area when the freeze area diameter is greater than 2". When the cross-sectional dimension is less than 2", this dimensional relationship is varied as necessary for the particular casting circumstances involved so that the side walls of the mandrel between the bore and outer surface have sufficient strength and will not break during casting operations. Also, in some instances, it may be possible to eliminate the use of bore 98 and still obtain satisfactory results. This situation is most often present when casting smaller diameter tubular members.

With reference again to FIG. 2, it will be seen that mandrel body is dimensioned so that when it is properly installed in the die, mandrel portion side walls 100,102 and 104 are spaced from internal die surface 52 to thereby define an elongated generally annular casting chamber generally designated 120. During a casting operation, molten metal enters chamber 120 from the crucible through metal intake openings 26 spaced peripherally around shell 50. As this molten metal flows past entry area 88 toward freeze area 90, it begins to transform from a liquid state to a solid state thus forming tubular strand C. The intermittent movement of pinch rolls (not shown) in pulling the strand outwardly from exit end 56 of the die allows this transformation to be substantially completed at or within the freeze zone. The tapering of end area 92 is such that as the cast strand is intermittently pulled axially through the die from freeze area 90, the end area will not interfere with the internal surface or side wall 130 of the strand to thereby cause cracking or other imperfections therein.

Typically, each intermittent movement or stroke of the pinch rolls moves the strand somewhere in the range of approximately ½" to 1" at 30" per minute with various time intervals between strokes. The time interval between strokes is preset for a given cast tube size to insure freezing occurs along freeze area 90. The net velocity, Vn, of a tube having an inside diameter $=D_1$ and an outside $=D_2$ is given by the formula $Vn=KD_2/(D_2^2-D_1^2)$ where K is a constant appropriate to the alloy being cast. In addition to the stroke, three other variables are also important in securing the desired end casting result, i.e., adequate velocity during the stroke, correct metal temperature and correct net casting rate. All of these variables are interdependent on each other and one correct variable will not produce satisfactory castings if the other three are not also correct. The specifics of these variables are not involved in the present invention and are not, therefore, discussed in further detail herein since those skilled in the art will already have a sufficient understanding of the relationship therebetween. Still further, the specific metal or alloy being cast will, to some degree, affect the precise area at which the metal begins to actually solidify into the shape of tubular strand C, although substantially all of the solidification desirably occurs along freeze area 90.

Cooling of the strand to obtain transformation from a liquid to a solid state is obtained by means of cooler 66 and axial bore 98. Cooler 66 as noted above, may comprise any number or types of cooling arrangements and typically provides for the passing of cooling fluid or water therethrough in a direction generally opposite to the movement of the strand C to thereby maximize the heat transfer benefits of heat from the casting process to the cooling fluid. Axial bore 98 reduces heat transfer by conduction through the mandrel. That is, heat from the molten metal entering cavity 120 adjacent metal entry area 88 is prevented from being substantially transferred by conduction from the metal entry area to freeze and end areas 90,92. The bore substantially reduces the area of contact between the zones to thus limit the heat transfer in order that transformation of the metal from a liquid to a solid state may precisely and successfully substantially take place along side wall 102 of the freeze area. It is also deemed to be of significant value and importance to the present invention that bore 98 extend at least partially into metal entry area 88 to achieve the overall desired operational end results.

It should also be here noted that the cross-sectional dimensions of both freeze area 90 and internal surface 52 take into appropriate account shrinkage of cast strand C as it solidifies in order that the final internal and external dimensions may be obtained. Thus, FIG. 2 shows outside wall 132 of strand C slightly spaced from internal wall 52 of the die after the molten metal has solidified and begun to cool along freeze area 90. Tapered end area 92 allows the strand to be moved therepast without interference between side wall 104 thereof and internal wall 130 of the strand. Interference between these surfaces might otherwise cause strand sticking and strand imperfections or the like.

Because mandrel D includes a distinct freeze area axially therealong and which freeze area has a constant and appropriate cross-sectional dimension, internal strand wall 130 has a relatively smooth and constant surface configuration when compared to continuous cast strands using prior known mandrels in similar continuous casting facilities and operations.

It should again be pointed out that while the preferred arrangement shown and described above is with reference to forming a continuous cast cylindrical tube, the mandrel and die could be formed to generate strands having different or modified internal and external cross-sectional configurations. Such modifications in no way dapart from the overall intent or scope of the present invention. Moreover, the new and improved mandrel construction of the subject invention is deemed applicable to use with any metal conventionally processed by continuous casting and which does not seriously attack the preferred graphite construction of the mandrel.

The invention has been described with reference to the preferred embodiment. Obviously, modifications and alterations will occur to others upon the reading and understanding of this specification. It is intended to include all such modifications and alterations insofar as they come within the scope of the appended claims or the equivalents thereof.

Having thus described the invention, it is now claimed:

1. An apparatus for continuous casting of a generally tubular metallic member wherein molten metal is introduced into the entrance end of a die which includes a mandrel extending at least partially therethrough and wherein said molten metal solidifies as it passes through said die toward an exit end spaced from said entrance end and exiting therefrom as said tubular metallic member, the improvement comprising:

said mandrel comprising an elongated body having a longitudinal axis with a first end spaced adjacent said die entrance end and a second end spaced toward said die exit end, said body including at least a distinct freeze area spaced intermediate said first and second ends having a constant cross-sectional dimension longitudinally therealong and an end area tapering inwardly from said freeze area toward said second end, said body further including an elongated bore in said second end extending longitudinally inward into said body through said tapered end area, said freeze area and into at least a portion of said body between said freeze area and said first end whereby the amount of heat conducted through said body from said first to said second end is reduced during a continuous casting process.

2. The improvement as defined in claim 1 wherein said body tapers outwardly from said freeze area toward said first end.

3. The improvement as defined in claim 1 wherein said bore has a cross-sectional dimension of approximately 1" less than the cross-sectional dimension of said freeze area when said freeze area has a cross-sectional dimension greater than approximately 2".

4. The improvement as defined in claim 3 wherein said freeze area and bore have generally circular cross-sections.

5. The improvement as defined in claim 1 wherein said body has a length of approximately 5" between said first and second ends.

6. The improvement as defined in claim 1 wherein said body freeze area has a length of approximately 1".

7. The improvement as defined in claim 6 wherein said end area has a length of approximately 1½".

8. The improvement as defined in claim 6 wherein said bore extends from said freeze area into that portion of said body between said freeze area and first end a distance approximately equal to 1".

9. A mandrel for use in the continuous casting of a generally tubular metallic member wherein said mandrel is operably received in and disposed to extend axially through at least a portion of a die from a die entrance end toward a die exit end with the outer surface of said mandrel and the inner surface of said die defining a chamber wherein said tubular metallic member is cast, said mandrel comprising:

an elongated graphite body having a longitudinal axis with a first mandrel end including means adjacent thereto adapted to fixedly position said mandrel relative to said die adjacent said die entrance end with a second mandrel end spaced toward said die exit end, said body including at least a distinct freeze area spaced intermediate said first and second ends having a constant cross-sectional dimension longitudinally therealong to substantially accommodate freezing of metal in a desired configuration from a molten liquid to a solid state when casting said tubular member, said body further including an end area tapering inwardly from said freeze area toward said second end to accommodate free passage of said tubular member thereover and outwardly from said die exit end.

10. The mandrel as defined in claim 9 wherein said freeze area has a length of approximately 1".

11. The mandrel as defined in claim 9 wherein said body further includes an elongated bore in said second end extending longitudinally inward into said body through said tapered end area, said freeze area and into at least a portion of said body between said freeze area and said first end whereby the amount of heat conducted through said body from said first to said second end is reduced during a continuous casting process.

12. The mandrel as defined in claim 11 wherein said bore extends from said freeze area into that portion of said body between said freeze area and said first end a distance approximately equal to 1".

13. A mandrel for use in the continuous casting of a tubular metallic member wherein said mandrel is operably received in and disposed to extend axially through at least a portion of a die from a die entrance end, the outer surface of said mandrel and the inner surface of said die defining a chamber wherein said tubular member is cast, said mandrel comprising:

an elongated graphite body having a longitudinal axis with a first mandrel end including means adjacent thereto adapted to fixedly position said mandrel relative to said die adjacent said die entrance end with a second mandrel end spaced toward said die exit end and wherein the distance between said first and second ends is approximately 5", said body including at least a distinct freeze area intermediate said first and second ends having a length of approximately 1" with a constant cross-sectional dimension longitudinally therealong to substantially accommodate freezing of metal in a desired configuration from a molten liquid to a solid state when casting said tubular member and an end area tapering inwardly from said freezing area toward said second end to accommodate free passage of said tubular member thereover and outwardly from said die exit end, said body further including an elongated bore in said second end extending longitudinally inward into said body through said tapered end area, said freeze area and into that portion of said body between said freeze area and said first end a distance of approximately 1" whereby the amount of heat conducted through said body from said first to said second end is reduced during a continuous casting process.

14. The mandrel as defined in claim 13 wherein said bore has a cross-sectional dimension of approximately 1" less than the cross-sectional dimension of said freeze area when said freeze area has a cross-sectional dimension greater than approximately 2".

* * * * *